United States Patent [19]

Kreft et al.

[11] Patent Number: 5,068,613

[45] Date of Patent: Nov. 26, 1991

[54] METHOD AND APPARATUS FOR GENERATING DISPLAY WAVEFORMS IM WASTED SPARK IGNITION SYSTEMS

[75] Inventors: Keith A. Kreft, Arlington Heights; Michael Dikopf, Palatine; Thomas D. Loewe, Wonder Lake, all of Ill.

[73] Assignee: Sun Electric Corporation, Crystal Lake, Ill.

[21] Appl. No.: 256,168

[22] Filed: Oct. 11, 1988

Related U.S. Application Data

[63] Continuation of Ser. No. 26,837, Mar. 17, 1987, abandoned.

[51] Int. Cl.[5] ..... F02P 17/00

[52] U.S. Cl. ..... 324/379; 73/116; 324/402

[58] Field of Search ..... 324/379, 397, 384, 402, 324/399, 393, 394; 73/116, 119 R

[56] References Cited

U.S. PATENT DOCUMENTS

| | | | |
|---|---|---|---|
| 4,379,263 | 4/1983 | Everett et al. | 324/379 |
| 4,644,284 | 2/1987 | Friedline et al. | 324/397 |
| 4,742,306 | 5/1988 | Everett et al. | 324/393 X |

*Primary Examiner*—Kenneth Wider
*Assistant Examiner*—Robert W. Mueller
*Attorney, Agent, or Firm*—Nicholas A. Camasto

[57] ABSTRACT

A method and apparatus of developing a stabilized power firing event signal for a cylinder in a wasted spark ignition system having pairs of complementarily connected cylinders, each with a spark plug connected to an opposite end of an independent ignition coil. The first and second firing event signals are developed for each spark plug upon firing of the ignition coil. The first and second signals are combined with like polarity in a summation circuit for eliminating common mode signal portions. The combined signal, which is now stabilized and accurately indicates spark duration, is used for capturing secondary ignition data and may be visually displayed for analysis.

9 Claims, 4 Drawing Sheets

METHOD AND APPARATUS FOR GENERATING DISPLAY WAVEFORMS IM WASTED SPARK IGNITION SYSTEMS

This application is a continuation of Ser. No. 026,857, filed Mar. 17, 1987, now abandoned.

CROSS REFERENCE TO RELATED APPLICATION

This application is related to application Ser. No. 686,203, filed Dec. 26, 1984, in the names of James G. Friedline and Leo G. Rich, entitled DISTRIBUTORLESS IGNITION SYSTEM INTERFACE FOR ENGINE DIAGNOSTIC TESTERS, now U.S. Pat. No. 4,644,284, issued Feb. 17, 1987, and application Ser. No. 941,630, filed Dec. 15, 1986, in the names of Keith Kreft, Michael Dikopf and Thomas Loewe, entitled METHOD AND APPARATUS FOR DETERMINING CYLINDER #1 POWER FIRING EVENT IN WASTED SPARK IGNITION SYSTEMS, both assigned to SUN ELECTRIC CORPORATION and both of which are incorporated by reference herein.

BACKGROUND OF THE INVENTION

The above-referenced application Ser. No. 686,203 describes and claims interface apparatus for enabling conventional automotive diagnostic and test equipment to be used with certain types of direct ignition systems, also referred to as wasted spark or distributorless ignition systems. In a wasted spark ignition system an individual ignition coil, each consisting of a primary winding and a secondary winding, is provided for each pair of cylinders, with the ends of the secondary windings being connected to the spark plugs of the respective cylinders. A six cylinder engine, therefore, has six spark plugs supplied by three secondary coil windings and there is no ground voltage reference for the secondary coil windings. When an individual ignition coil secondary winding is "fired", opposite polarity voltages are developed across its ends, and the two spark plugs connected to the secondary winding are fired together. The cylinder pairs are arranged so that one spark plug fires near the end of the compression stroke of its cylinder and its opposite paired spark plug fires near the end of the exhaust stroke of its cylinder. In practice, the wasted spark, that is, the spark produced near the end of the exhaust stroke of its cylinder, has a smaller amplitude than its counterpart power spark because it is not exposed to a gasoline/air mixture that is under compression. The wasted spark actually occurs earlier since the breakdown voltage of the exhaust mixture is significantly lower than the breakdown strength of the charged (pressurized) gasoline/air mixture. Since both spark plugs are connected in series through the ignition coil secondary winding, the wasted spark circuit is initially completed through the parasitic capacitances of the system, that is, the capacitances of the spark plug, spark plug wires, etc. to ground. Upon subsequent occurrence of the power spark, its conductive path includes the parasitic capacitances in addition to the discharge path through the other spark plug.

Conventional engine analyzers generally employ a secondary ignition system pattern pickup lead to obtain information regarding the performance of the secondary ignition system of the engine for processing and analysis. This information is typically sensed using a capacitive clamp-on pickup around the secondary coil wire between the ignition coil and the distributor. On an ignition system employing an integrated coil and distributor, such as the General Motors Corporation HEI system, use of a capacitive plate adapter may be required.

In a conventional engine, there is only one cylinder firing event per cylinder for each complete engine cycle (two engine revolutions in a four-cycle engine) and hence only one cylinder firing at a time. Also, all cylinder firings are in the same polarity direction. Consequently, there is no confusion as to what secondary signals are displayed when the secondary pattern pickup lead that is connected to a tester develops a signal. In a wasted spark system, the secondary windings of the ignition coils are each floating, with respect to engine ground, between a pair of spark plugs. This is in contrast to the autotransformer type of ignition coil in a conventional engine, which has a fixed engine ground reference. The result is that the voltages appearing on the secondary coils in a wasted spark system fluctuate with respect to engine ground. This could lead to misinterpretation of signals displayed on the screen and possibly erroneous data being processed by the engine analyzer. In the wasted spark system, two simultaneous firing events occur, one for the power firing of each cylinder and another for the wasted firing which occurs during the power firing of its complementary pair cylinder.

In both of the disclosed apparatuses of the above-referenced applications, the cylinder #1 power firing event signal is differentiated from the cylinder #1 wasted firing event signal so that proper synchronizing information is applied to the tester. A power firing event is herein defined as that corresponding to the cylinder being spark ignited near the end of its compression stroke (or near the beginning of its power stroke) and a wasted firing event is that which occurs when the cylinder is fired near the end of its exhaust stroke (or near the beginning of its intake stroke). Since, in a normally operating engine, the power firing event signals are larger than the wasted firing event signals, they can generally be differentiated based upon amplitude. In U.S. Pat. No. 4,644,284, the signals are compared with a fixed reference to determine which are the power firing event signals, whereas in application Ser. No. 941,630, the different firing event signals from all cylinders are sorted into two separate groups and a weighted average of the relative amplitudes of the two groups is obtained to determine the group that represents the power firing events and the group that represents the wasted firing events. In this way, one or two abnormally operating cylinders will not significantly affect the outcome of the determination.

The signal amplitudes are, of course, dependent upon spark plug condition and the type of vehicle. Also, since the wasted spark path and the power spark path are substantially coextensive, a problem in either of the two cylinders, in either of the two spark plugs or in the wiring will have a decided effect on the signal waveforms captured.

In the past, the secondary power firing waveforms have been processed to capture secondary ignition information as well as being displayed on the cathode ray tube (CRT) of a tester. The ignition data and their waveforms have provided valuable assistance in diagnosing engine problems. The difficulty is that in wasted spark ignition systems, the interrelationship between the power spark and the wasted spark significantly and adversely affects the signals and information captured, both for display and processing. It is therefore highly desirable to have some means for compensating for this interrelationship and to provide stable, accurate waveforms for processing and display of the wasted firing event signals and the power firing event signal.

OBJECTS OF THE INVENTION

A principal object of the invention is to provide apparatus for reliably testing wasted spark ignition systems.

Another object of the invention is to provide reliable signals for processing and display of secondary ignition information from wasted spark ignition systems.

Another object of the invention is to provide alternate secondary firing information, other than the power firing event presently used in conventional test equipment for display and processing.

DESCRIPTION OF THE DRAWINGS

These and other objects and advantages of the invention will be apparent upon reading the following description in conjunction with the drawings in which.

DESCRIPTION OF THE PREFERRED EMBODIMENT

Figure 1:
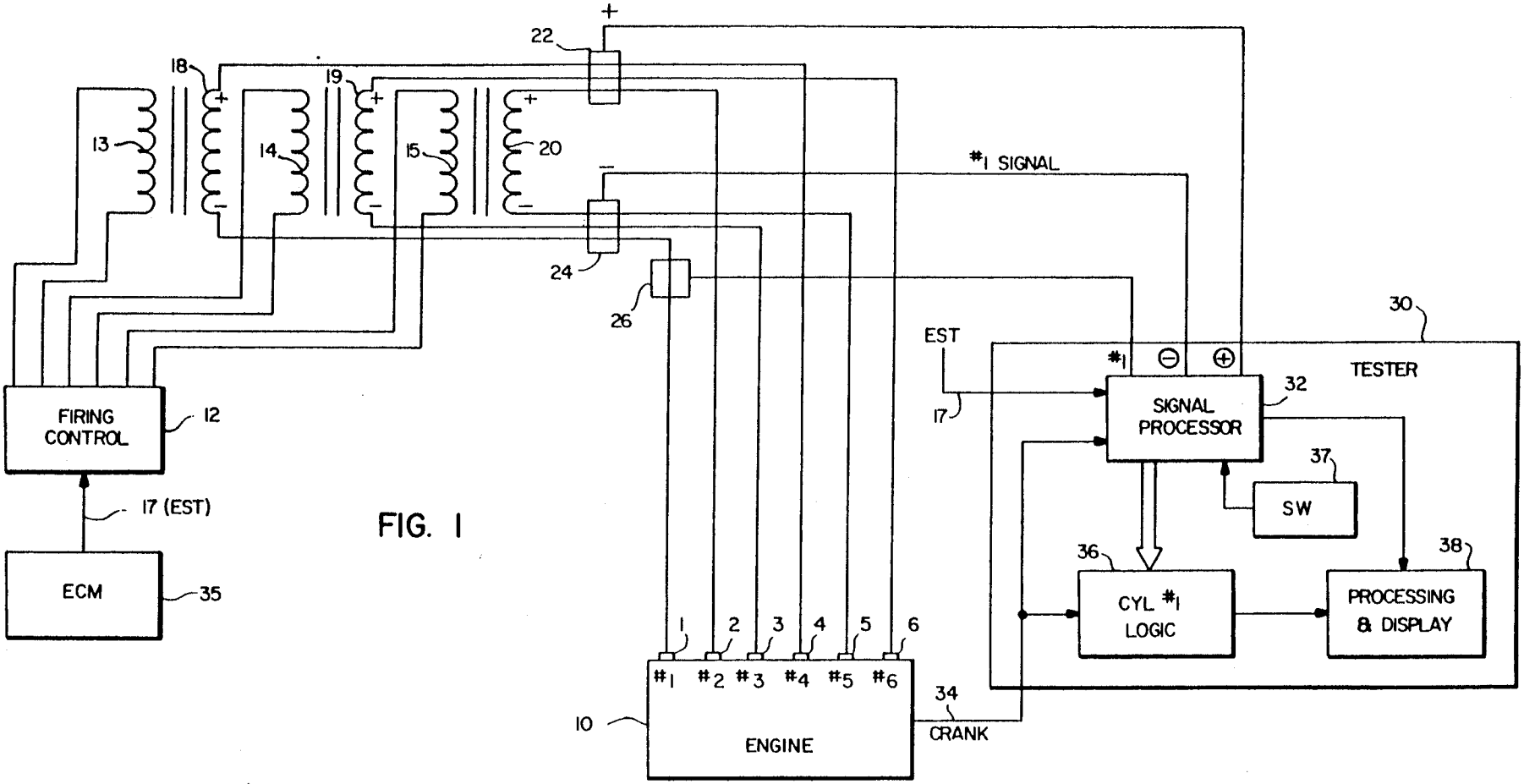
FIG. 1 represents a simplified block diagram of a wasted spark ignition system.

Referring to the drawings, FIG. 1 represents a simplified partial block diagram of an engine and tester for practicing the invention. Engine 10 is shown with six cylinders, arbitrarily labelled #1, #2, #3, #4, #5 and #6 and six corresponding spark plugs 1–6, inclusive.

A block 12 labelled FIRING CONTROL is coupled to a group of three primary ignition coil windings 13, 14 and 15 of three separate ignition coils which are sequentially energized and de-energized to cause firing voltages to be developed across three secondary windings 18, 19 and 20, respectively, under control of an Electronic Spark Timing (EST) signal 17 supplied from an Electronic Control Module (ECM) 35. The EST signal is developed from a crank signal that is produced when the engine rotates and is very similar to the crank signal except that one of the EST signal edges is representative of exactly when each cylinder firing is desired, as determined by ECM 35. The crank signal may be conveniently developed by a notched flywheel and sensor arrangement that is well-known in the art. Each of ignition secondary windings 18, 19 and 20 has its respective ends connected to a separate pair of the spark plugs 1–6. Specifically, secondary winding 18 is connected across spark plugs 1 and 4, secondary winding 19 is connected across spark plugs 3 and 6 and secondary winding 20 is connected across spark plugs 2 and 5. Each secondary winding has a plus (+) and a minus (−) end, which may differ depending upon engine design, but will be fixed in any given installation. Thus, each spark plug 1–6 always fires with a given polarity voltage, whether it is a power firing or a wasted firing. In short, the polarities of the firing voltages for the spark plugs are known. For convenience, the wires and spark plugs will be simply referred to as positive or negative polarity, it being understood that the polarity designation refers to the firing voltage appearing thereon.

Two capacitive pickups 22 and 24 are coupled to the spark plug wires of like polarity to develop suitable positive and negative signals for application to a tester 30. Specifically, positive polarity pickup 22 is coupled to the wires connected to spark plugs 2, 4 and 6 and negative polarity pickup 24 is coupled to the wires connected to spark plugs 1, 3 and 5. A separate, preferably inductive clamp-on, pickup 26 is coupled to the #1 spark plug wire (or to its complement #4) to develop a #1 signal whenever spark plug #1 is fired. The signals from the pickups 22, 24 and 26 are supplied to a signal processor 32 in a tester 30 along with the EST signal 17. Engine 10 also provides a crank signal 34 which, as mentioned, represents a clock pulse derived from the engine flywheel, for example, and which serves as the synchronizing pulse for controlling generation of the EST signal. The crank signal 34 is supplied to signal processor 32 and to a cylinder #1 logic circuit 36. Cylinder #1 logic circuit 36 is also supplied with information from signal processor 32 and its output is supplied to processing and display apparatus 38. A switch 37 is coupled to signal processor 32 for selecting the waveform for display and processing by the tester. It will be appreciated that the tester may include other means for performing individual tests or a series of tests on engine 10 as well as apparatus for producing reports and the like, all as are well known in the art of automotive diagnostic testing.

Figure 2:
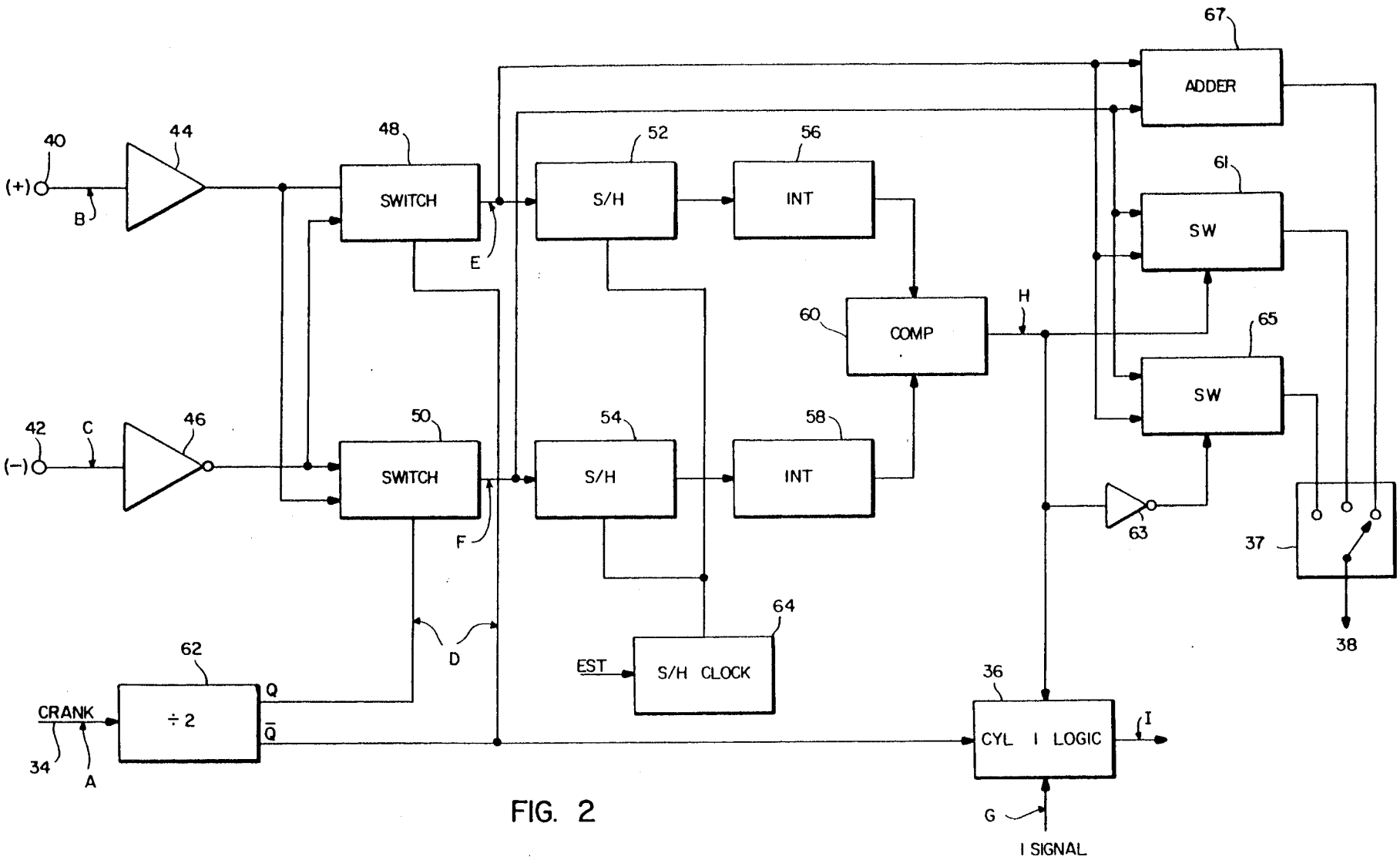
FIG. 2 represents a partial block diagram of the signal processor of FIG. 1.
Figure 3:
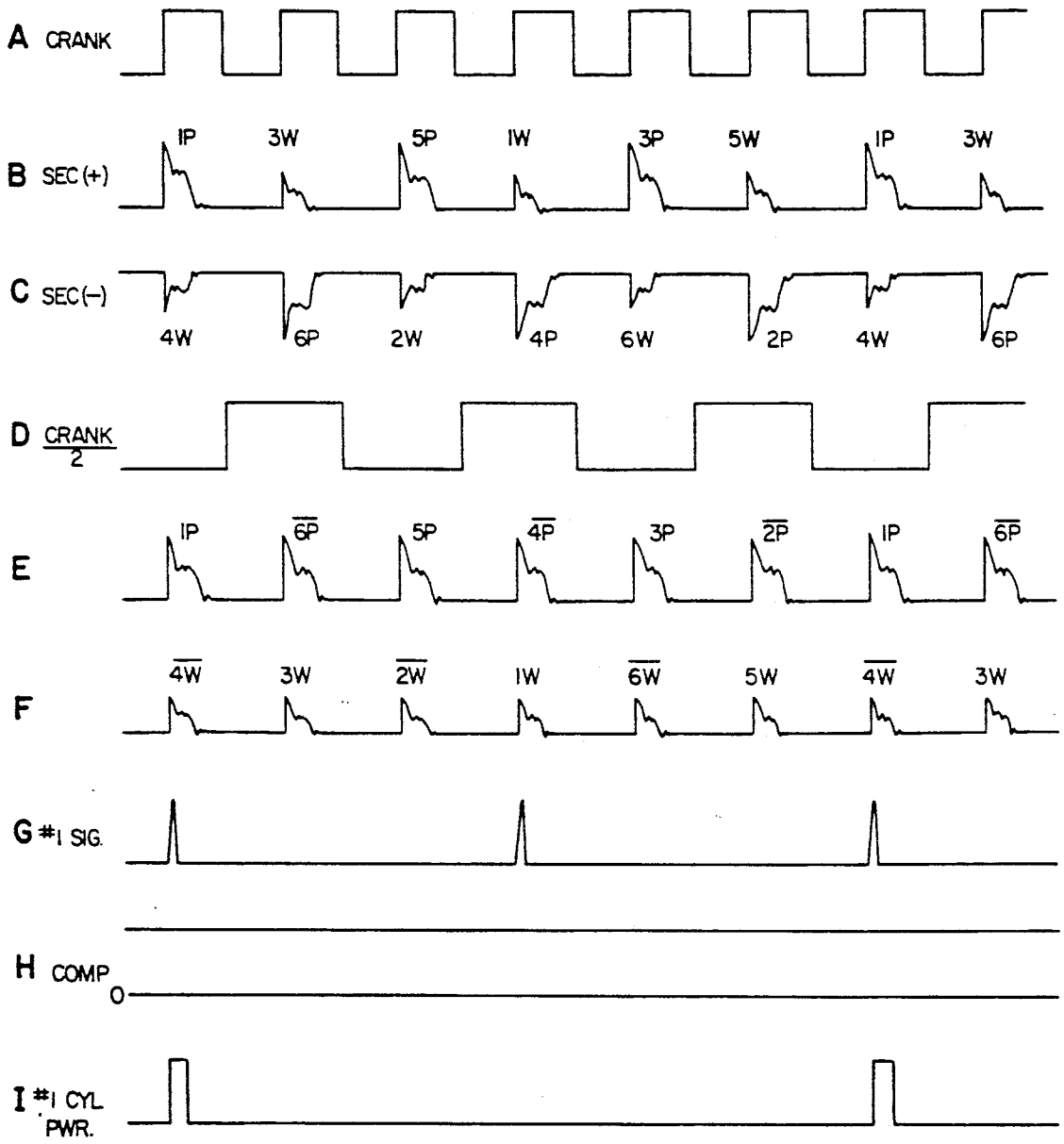
FIG. 3 represents a series of waveforms useful in explaining the invention.

FIGS. 2 and 3 may advantageously be viewed together for understanding the operation of signal processor 32. The letters A–I represent the individual signals or waveforms of FIG. 3 and are indicated at appropriate points about the block circuit diagram of FIG. 2. Waveform A represents the crank signal which is a square wave pulse train. B and C represent the positive and negative trains of firing event signals from secondary windings 18, 19 and 20. It will be appreciated that these waveforms are readily available from the outputs of the pickups 22 and 24, with B appearing on 22 and C appearing on 24. As illustrated, the firing order of the engine is 1-6-5-4-3-2, with the negative spark voltages being applied to cylinders 1, 3 and 5 and the positive spark voltages being applied to cylinders 2, 4 and 6. All power event signals represented by B, C, E and F are shown with larger amplitudes than the wasted events and are additionally identified with a P, while the wasted event signals are identified with a W. The bar appearing over the cylinder # and firing event type identifier, indicates that the cylinder firing event signal has been inverted with respect to its original polarity. For example, $\overline{6}$W is used to identify the inverted waveform of cylinder #6 firing in its wasted mode.

It should be appreciated, given that as a cylinder is fired in its power mode and the cylinder sharing the same ignition coil secondary winding is fired in its wasted mode at or near the top of its exhaust stroke, that each cylinder pair sharing the same ignition coil secondary winding must appear opposite each other in the firing order. Hence, both the polarity and position in the firing order of each cylinder pair sharing the same ignition coil secondary winding are opposite each other. The series of waveforms of positive polarity is supplied to a terminal 40 connected to the input of a buffer amplifier 44, the output of which is connected to one input each of a pair of analog switches 48 and 50. The series of waveforms of negative polarity is supplied to a terminal 42 connected to the input of an inverting amplifier 46, the output of which is also connected to each of the other inputs of switches 48 and 50. The crank signal 34 is supplied to a divide-by-two counter 62 having a Q output and a $\overline{Q}$ output, respectively, connected to switches 50 and 48. These signals are indicated as waveform D although it will be recognized that the particular polarity of waveform D is dependent upon whether the Q or its opposite $\overline{Q}$ output is selected, only one of which is illustrated. The divide-by-two counter 62 controls the switching of switches 48 and 50 to provide the train of one type of firing event signals (i.e., either power or wasted) at the output of switch 48 and the train of the other type of firing event signals at the output of switch 50. These signals are identified by waveforms E and F, respectively, and are supplied to sample-and-hold (S/H) circuits 52 and 54, respectively.

In this particular example, the power firing events are shown by waveform E and the wasted firing events are shown by waveform F. (The reverse could also have been shown.) For the six cylinder engine as described by the plug polarities and firing order shown, the signal trains from pickups 22 and 24 comprise alternating power and wasted firing events. After inverting one of the signal trains, it is, therefore, a simple matter to sort the wasted signals into one group and the power signals into another (although their identification status is as yet undetermined) by means of the switching arrangement disclosed. As should be apparent, engines of different configurations may be treated with the same method, it being necessary to know, in addition to a timing signal denoting a cylinder #1 firing event (a #1 signal), the polarities of the spark plugs and the engine firing order. With that information, the wasted and power event signals may be sorted into two groups.

To recapitulate, in the six cylinder engine shown, all of the odd-numbered plugs receive positive spark voltages and all of the even-numbered plugs receive negative spark voltages. With the firing order shown, all of the power firing event signals and wasted firing event signals are conveniently "sorted" by switches 48 and 50. For other numbers of cylinders and firing orders, the switches 48 and 50 need to be operated in a sequence determined by the firing order and a knowledge of the "polarity" of the spark plug voltages to assure the correct signals are inverted and that all of the power firing event signals are supplied to one integrator and all of the wasted firing event signals are supplied to the other integrator.

S/H circuits 52 and 54 are both supplied with a signal from S/H clock 64 that is derived from EST signal 17. S/H circuits 52 and 54 operate to hold or sustain the peak amplitudes of the input signals E and F as each is captured during operation of the S/H clock 64. The outputs of S/H circuits 52 and 54 are respectively supplied to a pair of integrator circuits 56 and 58 where the time weighted average of the amplitudes of the two groups of firing event signals are determined. The outputs of integrators 56 and 58 are supplied to a comparator 60 where an amplitude comparison is made and a suitable polarity output potential is developed as a result thereof. As shown, the comparator output waveform H is high when the amplitude of the weighted average of waveform E (representing power firing events) is greater than the amplitude of the weighted average of waveform F (representing wasted firing events). This signal is applied to cylinder #1 logic block 36 along with the #1 signal G and the $\overline{Q}$ output of the divide-by-two counter 62 to determine which of the cylinder #1 firing event signals G is to be used to generate the I signal, representing the cylinder #1 power firing event. The output of comparator 60 is also supplied directly to a switch 61, and, through an inverter 63, to a switch 65. Both switches 61 and 65, and an adder circuit 67 are supplied with the E and F signals. Their outputs are applied to respective terminals of switch 37 for selective application to the processing and display apparatus 38 of the tester 30. Such circuits may be conventional in construction.

As will be apparent to those skilled in the art, the crank signal 34 and the EST signal 17 are used as cylinder clock signals in the preferred embodiment. These signals may be substituted for by similar signals generated from the firing event pulse trains B and C as is well known in the art of engine test equipment design. It should also be obvious that sorting of signals B and C is not necessary to generate the "added" waveform. For example, the signals E and F may be developed by a simple summation of the outputs of 44 and 46, i.e., waveforms B and $\overline{C}$.

The output of adder 67 develops the summed signal. In the summed signal, common mode rejection is achieved. This has a very beneficial result of eliminating the common mode signals in the real and wasted spark voltages and in the displays. The added or summed secondary signals removes random variations which have not been previously seen on conventional ignition systems and which may serve to confuse rather than enlighten the technician. Of even greater impart, the summed signal establishes a stable base line for displaying and processing the secondary information. Thus, instead of a display (or signal) that "bounces" erratically, a stable, referenced signal is developed for processing and display.

Figure 4:
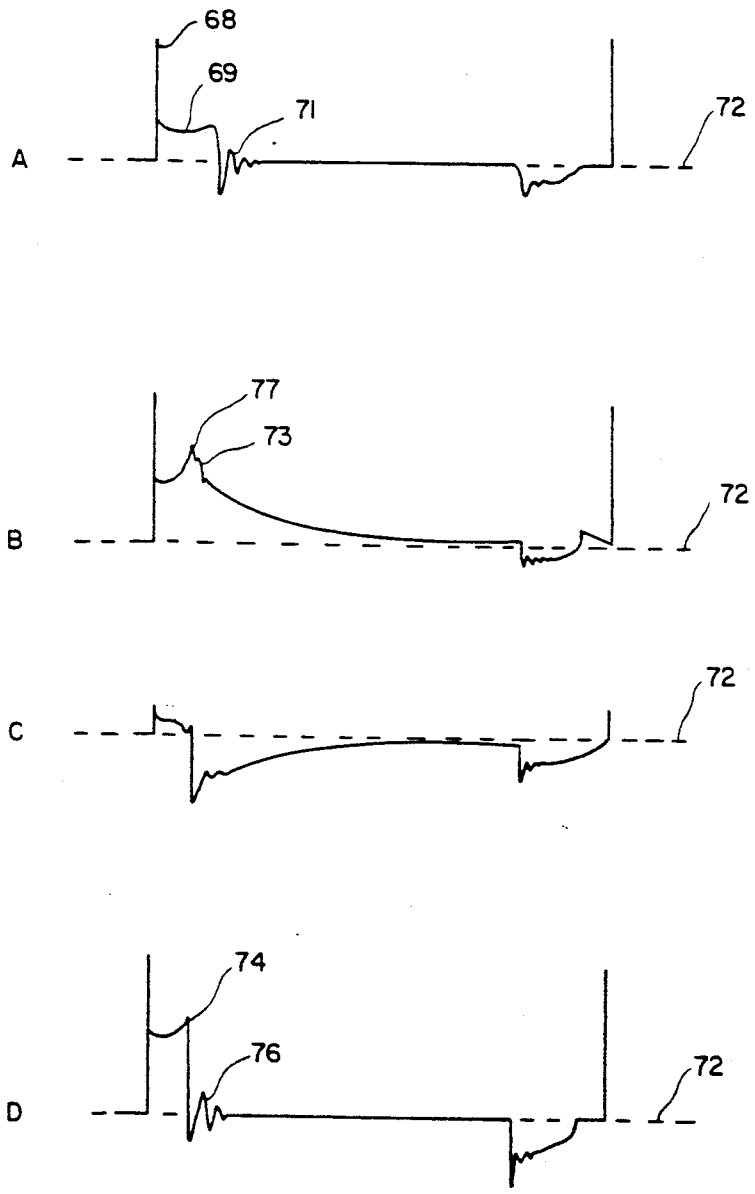
FIG. 4 represents an expanded series of waveforms depicting a power spark, its wasted spark complement and the sum of the power spark and the wasted spark.

Waveform a of FIG. 4 shows a secondary ignition waveform for one cylinder firing of a conventional ignition system as it would appear on the CRT of a tester. Of typical interest to a mechanic diagnosing the performance of the ignition system are: the amplitude of the ignition or firing voltage 68, the amplitude, slope and duration of the spark voltage 69 and the number of coil oscillations 71 appearing after the spark extinguishes. The voltage amplitudes are generally measured with respect to a zero reference voltage 72. Some testers merely display this waveform for analysis by the mechanic, while others measure and display these various parameters digitally.

Waveform b of FIG. 4 shows the power firing event of a wasted spark ignition system, while waveform c of FIG. 4 shows its simultaneously occurring wasted firing event. Note that the power firing waveform has most of the elements 68–71 of the conventional ignition system waveform. Notably lacking is a stable zero reference voltage and, as can be seen clearly, the sinusoidal characteristic of the coil oscillations 73 is grossly distorted. This leads to erroneous interpretations of voltage amplitudes, and yields an unstable waveform display as the CRT data is updated with time. Digitally measured parameters, obtained from this waveform, are adversely affected as well and are generally unstable. In a spark duration measurement, for example, the end of the spark is usually defined (for purposes of data capture) as the point at which the voltage crosses zero. In the wasted spark ignition system, a grossly erroneous spark duration measurement may be acquired by the test equipment.

Waveform d of FIG. 4 shows the summed waveform which is waveform b and waveform c added together. In waveform d, the all-important spark terminating portion 74 is very well-defined and trailing portion 76 is seen to clearly represent coil ringing by its sinusoidal character. The waveform d display is stable, that is, it does not bounce around on the CRT, has a stable zero voltage reference, and is very much like a conventional ignition system waveform that the technician is used to observing during power firing. Waveform b, on the other hand, is difficult to interpret, especially in the area of spark cutoff identified by reference numeral 77. Needless to say, the actual data represented by the waveform d display is stable and readily measurable.

It is recognized that numerous changes and modifications in the described embodiment of the invention will be apparent to those skilled in the art without departing from the true spirit and scope. The invention is to be limited only as defined in the claims.

What is claimed is:

1. A method of developing a stabilized firing event signal in a cylinder for a wasted spark ignition system wherein the spark plugs of a pair of complementary cylinders are fired simultaneously from opposite ends of an ignition coil secondary winding, comprising the steps of:

obtaining separate firing event signals from the spark plug ignition wires associated with the pair of cylinders;

sorting the firing event signals into first, power spark signals and second, wasted spark signals of like polarity;

combining the power spark signals and wasted spark signals together to eliminate common mode signal components therefrom; and developing visual displays of power spark signals, wasted spark signals and combined power spark signals and wasted spark signals.

2. Apparatus for developing a stabilized firing event signal in a wasted spark ignition system comprising:

a first and a second cylinder;

first and second spark plugs associated with said first and said second cylinder, respectively;

a secondary ignition coil winding having its respective ends coupled to said first and to said second spark plugs;

pickup means for developing first and second firing event signals from said first and said second spark plugs upon firing of said ignition coil winding;

means for developing from said first and said second firing event signals, a power spark signal and a wasted spark signal of like polarity;

means for combining said power spark signal and said wasted spark signal to eliminate common mode signal components therefrom; and means for displaying said power spark signal, said wasted spark signal and said combined power spark and wasted spark signals.

3. A method of developing a stabilized firing event signal for a cylinder in a wasted spark ignition system wherein the spark plugs of a pair of complementary cylinders are fired simultaneously from opposite ends of an ignition coil secondary winding comprising the steps of:

developing first and second signals from the firing events of the associated pair of cylinders; and combining said first and second signals to eliminate common mode signal components therefrom.

4. The method of claim 3 wherein said developing step comprises the step of:

obtaining said first and second signals from the spark plug ignition wires associated with said pair of cylinders; and wherein said combining step comprises the step of;

supplying said first and second signals with like polarity to a summation circuit.

5. The method of claim 4, further including the step of developing a visual display of said combined first and second signals.

6. Apparatus for developing a stabilized firing event signal in a wasted spark ignition system comprising:

a first and a second cylinder;

first and second spark plugs associated with said first and said second cylinder, respectively;

a secondary ignition coil winding having its respective ends coupled to said first and said second spark plug;

means developing first and second firing event signals from said first and said second spark plugs upon firing of said ignition coil winding; and means combining said first and said second firing event signals to eliminate common mode signal portions.

7. The apparatus of claim 6 wherein said combining means comprise a summation circuit and means for supplying said first and said second signals to said summation circuit with like polarity.

8. The apparatus of claim 7 wherein said ignition coil winding is connected to said first and said second spark plugs by ignition wires and wherein the means for developing said first and said second signals comprise pickup means associated with said ignition wires.

9. The apparatus of claim 8, further including means for visually displaying the combined first and second signals.

* * * * *

UNITED STATES PATENT AND TRADEMARK OFFICE

CERTIFICATE OF CORRECTION

PATENT NO. : 5,068,613

DATED : November 26, 1991

INVENTOR(S) : Keith A. Kreft, Michael Dikopf & Thomas D. Loewe

It is certified that error appears in the above-identified patent and that said Letters Patent is hereby corrected as shown below:

Title Page, in the Title, "IM", should be --IN--;

Column 1, line 2, delete "IM", insert --IN--;

line 6, delete "026,857", insert --026,837--.

Signed and Sealed this

Sixth Day of July, 1993

*Attest:*

Michael K. Kirk

MICHAEL K. KIRK

*Attesting Officer*

*Acting Commissioner of Patents and Trademarks*